United States Patent [19]

Coppier et al.

[11] Patent Number: 5,063,363

[45] Date of Patent: Nov. 5, 1991

[54] ELECTROMAGNETIC ENERGY RADIATION PICK-UP

[75] Inventors: Hervé Coppier, Noyon; Jean-Louis Pourailly, Vincennes; Joseph Roger, Bures sur Yvette, all of France

[73] Assignee: Thomson-CSF, Puteaux, France

[21] Appl. No.: 546,380

[22] Filed: Jun. 29, 1990

[30] Foreign Application Priority Data

Jul. 7, 1989 [FR] France ..... 89 09175

[51] Int. Cl.[5] ..... H01P 5/08

[52] U.S. Cl. ..... 333/33; 333/1; 333/128; 333/246

[58] Field of Search ..... 333/125, 128, 137, 21 R, 333/26, 33, 1, 246; 343/772, 859

[56] References Cited

U.S. PATENT DOCUMENTS

| | | | |
|---|---|---|---|
| 2,822,541 | 2/1958 | Sichak et al. | 343/786 X |
| 3,015,100 | 12/1961 | Rotman | 343/772 |
| 3,265,995 | 8/1966 | Hamasaki | 333/26 X |
| 3,579,149 | 5/1971 | Ramsey | 333/26 |
| 4,123,758 | 10/1978 | Shibano et al. | 343/830 |
| 4,263,568 | 4/1981 | Nemit | 333/26 X |
| 4,724,443 | 2/1988 | Nysen | 343/700 MS |

OTHER PUBLICATIONS

Onde Electrique, vol. 29, No. 2, Apr. 1989, Paris Fr., pp. 15–21.

*Primary Examiner*—Paul Gensler
*Attorney, Agent, or Firm*—Roland Plottel

[57] ABSTRACT

A pick-up for electromagnetic energy radiation guided between at least two parallel ground plates includes a plane conductive tongue positioned between the two ground plates in a plane parallel to these plates and pointed in the direction of propagation of the guided electromagnetic energy, and obstacles interposed between the ground plates and the tongue converting the electromagnetic energy guided between the two ground plates, propagated in transverse electromagnetic mode, into an electromagnetic energy that is propagated in transverse asymmetrical electromagnetic mode in a strip line structure formed by the tongue and the two ground plates.

5 Claims, 1 Drawing Sheet

ELECTROMAGNETIC ENERGY RADIATION PICK-UP

BACKGROUND OF THE INVENTION

1. Field of the Invention

The present invention concerns pick-up devices for electromagnetic energy radiation propagated between two ground plates, for example in a waveguide or in an optical Blass type matrix.

2. Description of the Prior Art

It may be recalled that an optical Blass type of antenna distributor allows for supplying an array of microwave energy radiating elements so as to set up several radiation patterns simultaneously, for example a sum pattern and a difference pattern, and that such a distributor has several microwave energy leading-in main lines. By means of obstacles, these main lines generate electromagnetic radiation that is propagated directionally between two ground plates and has to be picked up to supply an array of radiating elements.

There is a known way of picking up microwave energy radiation that is being propagated between two ground plates, by means of a loop system or by means of a plunger dipole perpendicular to the ground plate. These pick-up devices are complicated and difficult to apply.

SUMMARY OF THE INVENTION

An aim of the present invention is to provide a pick-up for electromagnetic energy radiation being propagated between two ground plates, that properly samples the field received, has a simple structure that is easy to manufacture and can be used for setting up the many outputs of an optical Blass matrix type distributor.

An object of the invention is a pick-up for electromagnetic energy radiation guided between at least two parallel ground plates, said pick-up including a plane conductive tongue positioned between the two ground plates in a plane parallel to these plates and pointed in the direction of propagation of the guided electromagnetic energy, and obstacles interposed between the ground plates and the tongue converting the electromagnetic energy guided between the two ground plates, propagated in transverse electromagnetic mode, into an electromagnetic energy that is propagated in transverse asymmetrical electromagnetic mode in the strip line structure formed by the tongue and the two ground plates.

Advantageously, the obstacles are formed by conductive strips that are oriented perpendicularly to the direction in which the guided electromagnetic energy radiation is propagated, and two of them are placed so that one is in front of the other, facing the tongue on a ground plate, the third being placed on the other ground plate.

BRIEF DESCRIPTION OF THE DRAWINGS

Other characteristics and advantages of the invention will emerge from the following description of an embodiment of the invention given by way of an example. This description shall be made with reference to the appended drawing, wherein.

DESCRIPTION OF PREFERRED EMBODIMENTS

Figure 3:
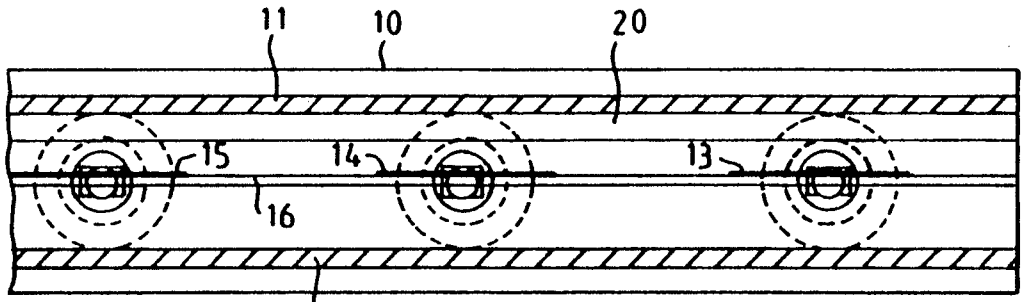
FIG. 3 is a cross-sectional view of the pick-up devices seen in FIG. 1.
Figure 2:
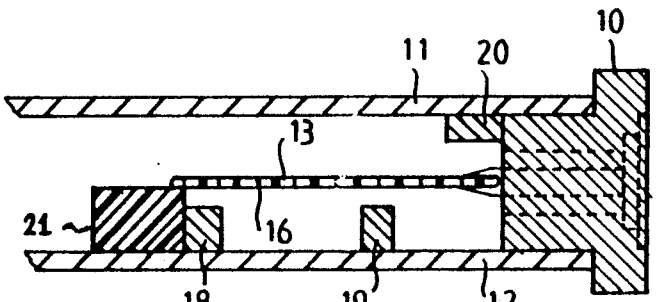
FIG. 2 is a longitudinal sectional view of one of the pick-up devices seen in FIG. 1.
Figure 1:
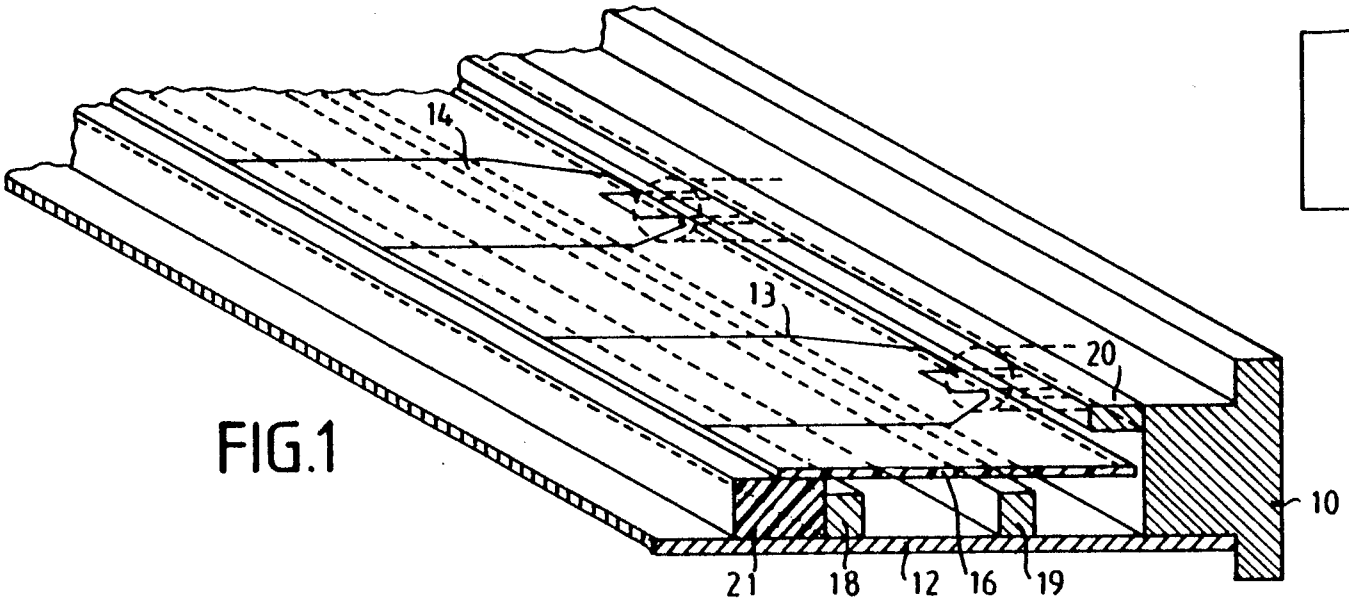
FIG. 1 is a cut-away partial view in perspective of electromagnetic energy radiation pick-up devices according to the invention.

FIGS. 1–3 show a row of electromagnetic energy radiation pick-up devices mounted side by side along one edge of a connection strip 10 that is fitted out, on its opposite edge, with coaxial connectors. This connection strip 10 is designed to close the longitudinal aperture of an optical Blass matrix type antenna distributor that takes the form of a hollow structure formed by two superimposed ground plates 11, 12 joined on one side and at the ends by side walls (not shown) and separated at the other side by a longitudinal aperture. Main lines (not shown) for leading in microwave energy are positioned within the hollow structure practically throughout its length. By means of obstacles suitably positioned between the ground plates 11, 12, these leading-in main lines generate electromagnetic radiation at spaced out locations corresponding to the spacing out of the pick-up devices on the connection strip 10. This radiation gets propagated transversally between the two ground plates 11, 12 towards the longitudinal aperture and pick-up devices, and is designed to excite the radiating elements.

Each pick-up device which is placed in the longitudinal aperture of the antenna distributor on the path of a transversal electromagnetic radiation has a plane conductive tongue 13, 14, 15 which is positioned between the two ground plates 11, 12 in a plane parallel to these ground plates and obstacles 18, 19, 20 placed facing the conductive tongue 13, 14, 15 against the ground plates 11, 12.

Figure 4:
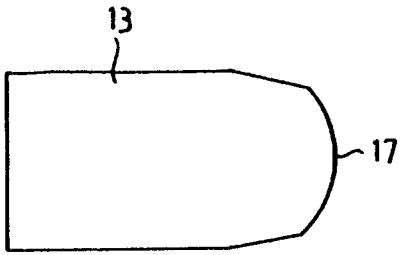
FIG. 4 is a view illustrating the profile of a conductive strip belonging to the pick-up devices shown in the preceding figures.

The conductive tongue 13, 14, 15 is oriented in the direction of the intercepted electromagnetic radiation and connected, through the connection strip 10, to a coaxial connector. With the two ground plates, it forms a dielectric triple plate strip line structure. It is formed by a copper pad imprinted with the pads of the tongues of the other pick-up devices on an epoxy glass wafer 16 mounted against the connection strip 10 in the median plane between the two ground plates 11, 12. The epoxy glass wafer is attached to the connection strip 10 by the pads which are electrically connected to the cores of the coaxial structures going through the connection strip 10 and ending at the coaxial connectors. On the side opposite the connection strip 10, this epoxy glass wafer 16 is supported by a dielectric foam block 21, shaped like a small bar, placed on the ground plate 12. Each printed copper pad as shown in FIG. 4 has a rectangular contour, the biggest dimension of which is oriented crosswise with respect to the connection strip 10, in the direction of the intercepted electromagnetic radiation, and the side 17 of this rectangular contour pointed towards the connection strip 10 is rounded and bevelled so as to form a transition for coaxial cables with low standing wave ratios.

The obstacles 18, 19, 20 convert the transverse electromagnetic mode in which the electromagnetic radiation to be picked up is propagated between the ground plates 11, 12 into a transverse asymmetrical electromagnetic mode capable of being propagated in the strip line structure formed by the conductive tongue 13, 14, 15, of the pick-up device and the two ground plates 11, 12. They are formed by three rectangular-sectioned metal strips 18, 19, 20, positioned in parallel with the connection strip 10 facing the conductive tongues 13, 14, 15 of the pick-up devices. Two of these metal strips, 18, 19 are positioned on one ground plate 12 and the third one 20 is positioned on the other ground plate 11. The cross-section of these strips 18, 19, 20 and their positions are determined by experiment so as to obtain a low standing wave ratio.

What is claimed is:

1. A pick-up for electromagnetic energy radiation guided between at least two parallel ground plates, said pick-up including a plane conductive tongue positioned between the two ground plates in a plane parallel to these plates and pointed in the direction of propagation of the guided electromagnetic energy, said plane conductive tongue being electrically unconnected to the parallel ground plates, and obstacles interposed between the ground plates and the tongue converting the electromagnetic energy guided between the two ground plates, propagated in the transverse electromagnetic mode, into an electromagnetic energy that is propagated in the transverse asymmetrical electromagnetic mode in a strip line structure formed by the tongue and the two ground plates, and wherein the obstacles are conductive strips that are positioned against the ground plates, facing the conductive tongue, and oriented perpendicularly to the direction in which the guided electromagnetic energy is propagated.

2. A pick-up according to claim 1, wherein the conductive strips are three in number, two of them being placed so that one is before the other, facing the tongue on one ground plate, and the third one is placed on the other ground plate.

3. A pick-up according to claim 1, wherein the conductive tongue is borne by an epoxy glue substrate.

4. A pick-up according to claim 1, wherein the conductive tongue has, opposite the direction from which the guided electromagnetic energy comes, a rounded and bevelled end forming a transition for coaxial cables.

5. A pick-up according to claim 4, wherein a conductive strip is fixed, on the side opposite the direction from which the guided electromagnetic energy comes, to a coaxial connector mounted across a transversal partition attached to the ground plates and supported, on the side oriented towards the direction from which the guided electromagnetic energy comes, by a block of foam made of a dielectric material placed on a ground plate.

* * * * *